US006319213B1

(12) United States Patent
Tomac

(10) Patent No.: US 6,319,213 B1
(45) Date of Patent: Nov. 20, 2001

(54) DEVICE FOR PASSIVE-MOTION TREATMENT OF THE HUMAN BODY

(76) Inventor: Stephan Tomac, Sveavagen 49, Str, 113 59 Stockholm (SE)

( * ) Notice: Subject to any disclaimer, the term of this patent is extended or adjusted under 35 U.S.C. 154(b) by 0 days.

(21) Appl. No.: 09/283,706

(22) Filed: Apr. 1, 1999

Related U.S. Application Data

(63) Continuation-in-part of application No. 08/676,372, filed on Jul. 16, 1996, now abandoned.

(30) Foreign Application Priority Data

Jan. 19, 1994 (SE) ..... 9400135-1

(51) Int. Cl.[7] ..... A61H 1/00

(52) U.S. Cl. ..... 601/53; 601/49; 601/90; 606/242

(58) Field of Search ..... 601/49, 53, 54, 601/90, 92; 606/242, 244, 245

(56) References Cited

U.S. PATENT DOCUMENTS

| | | | |
|---|---|---|---|
| 3,009,460 | 7/1961 | Leach | 601/53 |
| 3,590,812 | 7/1971 | Larson . | |
| 4,057,053 | 11/1977 | Kunz . | |
| 4,535,760 | 8/1985 | Ikeda et al. . | |
| 4,546,764 | 10/1985 | Gerber . | |
| 4,582,050 | 4/1986 | Willis . | |
| 4,619,006 | 10/1986 | Magnoni et al. . | |
| 4,969,451 | 11/1990 | Totten . | |
| 5,216,769 | 6/1993 | Eakin . | |
| 5,437,607 | 8/1995 | Taylor . | |
| 5,437,608 | 8/1995 | Cutler . | |

FOREIGN PATENT DOCUMENTS

| | | |
|---|---|---|
| 2919312 A1 | 11/1980 | (DE) . |
| 0329644 A2 | 8/1989 | (EP) . |
| 8104963 | 2/1993 | (SE) . |

OTHER PUBLICATIONS

Patent Abstracts of Japan, vol. 14, No. 458, C–766, Abstract of JP 2–185250 (Nagase Iron Works Co., Ltd.) Jul. 19, 1990.

*Primary Examiner*—Michael A. Brown
*Assistant Examiner*—Benjamin K Koo
(74) *Attorney, Agent, or Firm*—Fasth Law Offices; Rolf Fasth

(57) ABSTRACT

A device for passive-motion treatment of the human body comprises a body support platform that has a foot end and a head end and including a base section and a back support section which is movable relative to the base section along a longitudinal axis (L) extending between the foot end and the head end of the body support platform. The back support section or at least one subsection thereof is resiliently movable relative to the base section and connected with a vibrator by which the subsection is caused to vibrate in one or more directions. The body support platform exposes the spine of the human body to simultaneous longitudinal waves and a cyclical tilting motion so that the spine is moved in a cyclical helical path.

7 Claims, 9 Drawing Sheets

FIG. 4
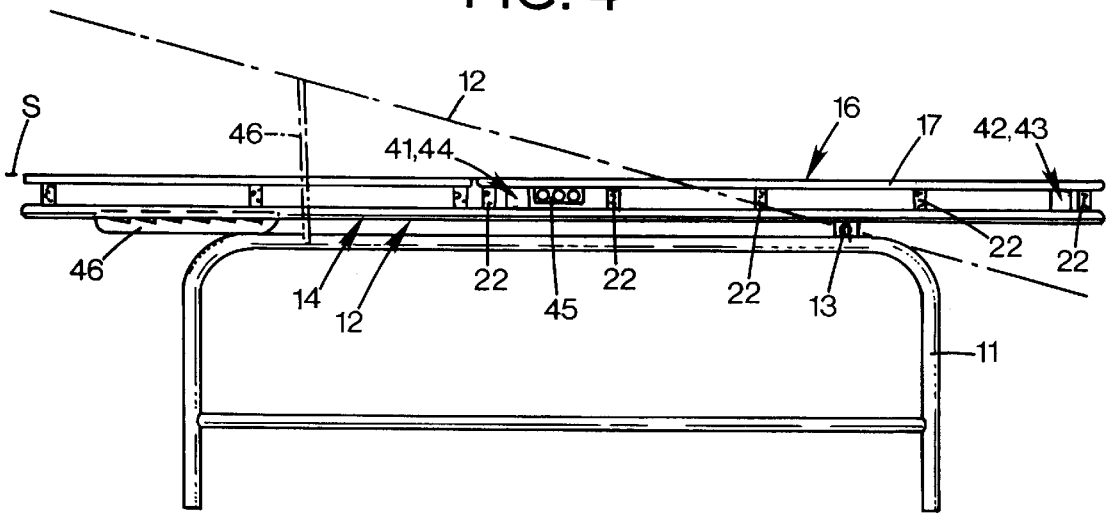
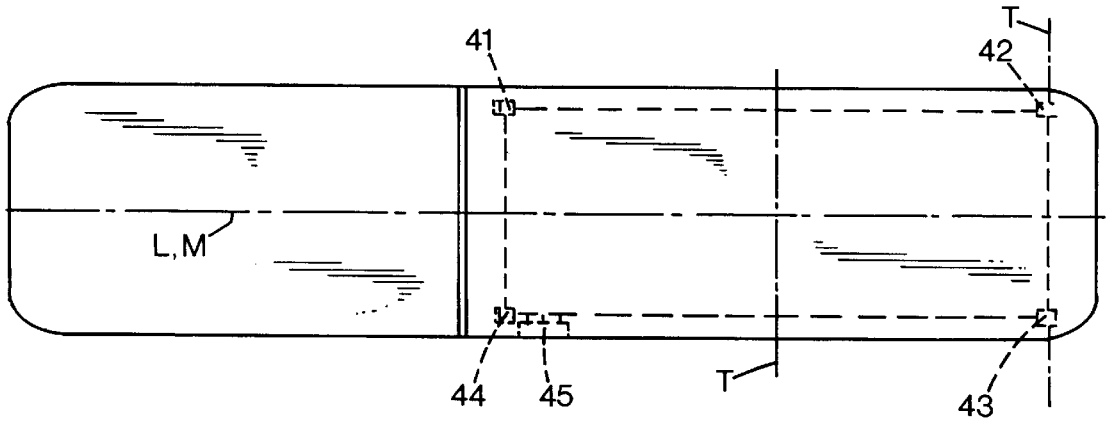
FIG. 5

DEVICE FOR PASSIVE-MOTION TREATMENT OF THE HUMAN BODY

PRIOR APPLICATION

This is a continuation-in-part application of U.S. patent application Ser. No. 08/676,372, filed Jul. 16, 1996, now abandoned.

TECHNICAL FIELD

This invention relates to a device for passive-motion treatment of the human body, that is a device for treating the body of a person without the person having to take an active part in the treatment. The treatment may be therapeutic or curative in nature but may also be carried out to improve the fitness of the person.

BACKGROUND AND SUMMARY OF THE INVENTION

More particularly, the present invention relates to a device comprising a body support platform having a base section and a back support section which is movable relative to the support platform, and a power-operated vibrator mechanism mechanically connected with the back support section. A device of this kind is disclosed in DE-A-2 919312. Despite many efforts in the past no acceptable solution for treating strained and injured backs have been developed.

An object of the invention is to provide an improved passive-motion treatment device.

Another object of the invention is to provide an improved device of the kind described above in which traction of the spine of the patient can be combined with an angular and/or undulating motion of the spine.

BRIEF DESCRIPTION OF THE DRAWINGS

FIG. 4 and FIG. 5 are respectively a side view and a plan view similar to FIG. 1 and FIG. 2 and show a second embodiment;

DETAILED DESCRIPTION

Figure 1:
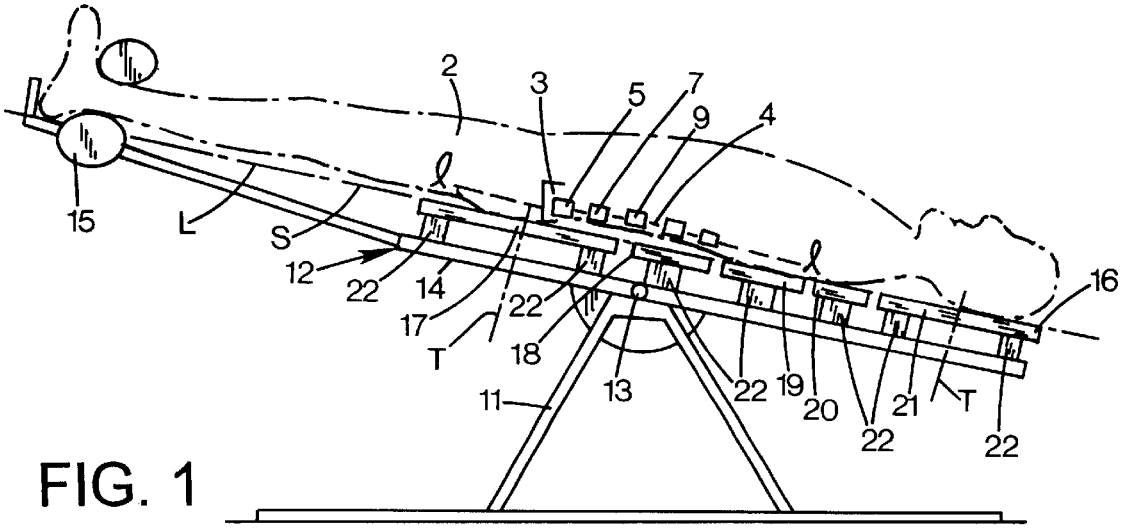
FIG. 1 is a side view of a first embodiment of a device according to the invention.

In the embodiments of the invention shown in the drawings, the passive-motion treatment device may be of the kind which is adapted for a combined traction and vibratory treatment of the upper portion of the body of a person, hereinafter referred to as a patient 2 having a pelvis 3. The person has a spine 4 has including first vertebra 5, second vertebra 7 and third vertebra 9 that extend along a longitudinal axis (1) of the spine 4. For this reason, and for convenience, the device is sometimes referred to below as a traction device.

Figure 2:
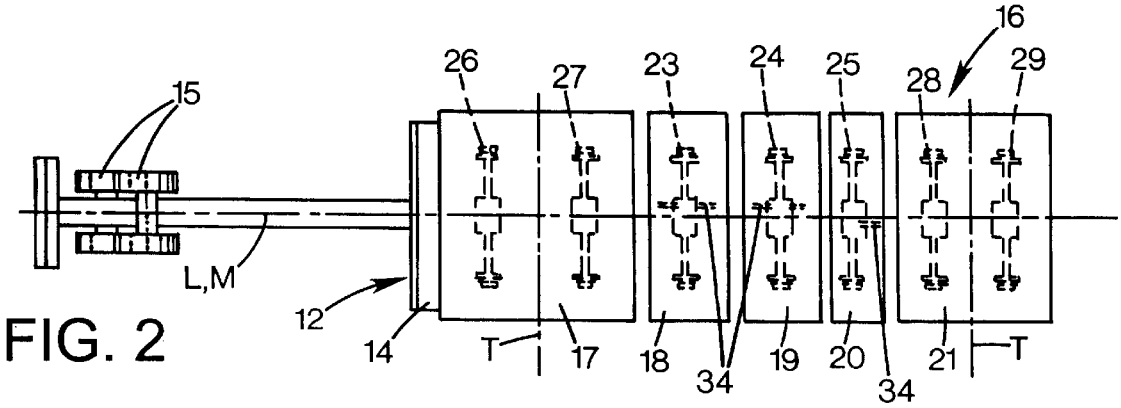
FIG. 2 is a plan view of the body support platform of the device of FIG. 1.
Figure 3:
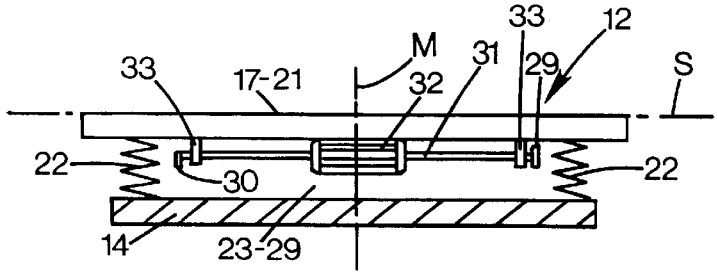
FIG. 3 is a cross-sectional view of the body support platform taken at the back support section thereof.

As shown in FIGS. 1–3, the traction device, according to the invention, comprises a bass or pedestal 11 supporting an elongate patient body support platform 12 which is tiltable on the base about a transverse horizontal axis 13 and can be locked in selected inclined positions by means of an arresting mechanism (not shown). During the treatment of a patient that needs to undergo treatment of his/her spine, the patient lies on his/her back on the body support platform with the spine oriented along the longitudinal axis L of the body support platform. This axis may be contained in a vertical plane M, hereinafter referred to as the medium plane.

A patient body support platform 12 may comprise a base section 14 which, disregarding its movability about the tilting axis 13, is stationary with respect to the base 11. Adjacent the foot end of the body support platform, the base section 14 carries a retaining device 15 for restraining the patient's feet against downward movement in the longitudinal direction of the body support platform. It is to be understood that the patient may be lying in a horizontal position or in a straight inclined position with the legs disposed in a position above the head. The patient may also be in position wherein the legs are upwardly inclined while the back is in the horizontal position.

Moreover, the body support platform 12 may comprise a generally rectangular and flat book support section, generally designated as 16, which supports the upper portion of the patient's body during the treatment. When relieved from the weight of the patient's body, the upper surface of back support section 16*b* lies in a horizontal plane 6, here referred to as the back plane, which is perpendicular to median plane M and contains longitudinal axis L. The back support section 16, or at least a subsection or subsections of it, can move in the direction of the longitudinal axis L over a short distance.

In the device according to the invention, the back support section 16 of the body support platform 12, or at least one portion or subsection thereof, is resiliently movable with respect to the base section 14 of the body support platform 12. In the illustrated embodiments, this movability exists not only in the longitudinal direction of body support platform 12, i.e., along axis L, but also in other directions, such as generally transversely of back plane S and/or angularly about a line parallel to tilting axis 13 and/or about axis L or a line generally parallel to axis L.

In the illustrated exemplary embodiments of FIGS. 1–3, the back support section 16 is subdivided longitudinally into five slightly spaced apart rectangular subsections 17, 18, 19, 20 and 21, all of which are resiliently mounted on the base section 14 of the body support platform 12 so that they are individually and omni-directionally movable relative to it. To this end, a set of resilient mounting members 22 are interposed between the base section 14 of the body support platform 12 and each subsection 17–21. The mounting members 22 may be of any suitable type and design. For example, they may be all rubber springs, all metal springs, or composite metal-rubber springs. If desired, abutments (not shown) may be mounted separately or integrated in the mounting members 22 to limit movements of the subsections 17–22 relative to the base section 14 and thereby prevent excessive stress on the mounting members 22.

The subsections 17–21 may be vibrated independently of one another by means of individual vibrators which are diagrammatically indicated at 23–39 in FIG. 2.

Figure 11:
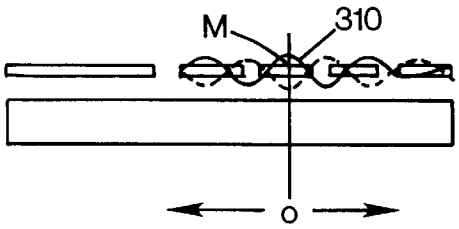
FIG. 11 is a schematic illustration of a shape of a total wave generated by the vibrators shown in FIG. 9.

As indicated diagrammatically in FIG. 3, each vibrator 23–29 may take the shape of unbalanced rotating masses 29, 30, secured to opposite ends of a common shaft 31 which is driven by an electric motor 32 and which is supported in bearings 33 on the associated subsection 17–21 and oriented generally horizontally and perpendicularly to the median plane M. The mass 29 protrudes in a direction that is opposite a direction of protrusion of the mass 30. The vibrators may also take the shape of electric reciprocatory linear motors (not shown), the reciprocating driven members of which are connected with the respective subsection 17–21 at positions corresponding to the positions of the bearings 33 in FIG. 3. In other words, the vibrators 23–29 may produce a first longitudinal cyclical wave 302 and a second longitudinal cyclical wave 304 that is delayed 120 degrees after the first wave 302 (see FIG. 12). The amplitude of a wave 300 is gradually reduced as the wave travels along the spine of the patient towards to head of the patient as shown by the arrow A. The gradually reduced amplitude is shown in FIG. 11 so that amplitude $a_1$ is greater than amplitude $a_2$. The vibrators may also simultaneously generate a cyclical tilting of the spine 4 about the longitudinal axis (1) because the support member may not only tilt about a transverse axis T but also along the longitudinal axis, as explained in detail below.

As is best shown in FIG. 3, the vibratable subsections may be vibrated in different vibration modes. For example, with the unbalanced rotating masses 29, 30 arranged to operate in phase opposition or push-pull fashion on opposite sides of longitudinal axis L of body support platform 12, the subsections will vibrate angularly about axis L and thus move in a seesaw fashion about axis L.

If in this vibration mode, the vibrators are arranged to vibrate synchronously but with progressively decreasing amplitude from subsection 17 to subsection 21 or in the opposite direction, the vertebrae of the patient's spine can be angularly moved back and forth through an angle that increases in one direction or the other along the length of the spine. In other words, the combined amplitude of all the waves produced by all the vibrators may be controlled so that the highest amplitude M may travel along the spine of the patient (see FIG. 10).

Alternatively, with the vibrators of each subsection arranged to vibrate in phase with one another on opposite sides of median plane M, the subsection may vibrate such that their orientation or altitude relative to the plane M and S remains the same throughout each cycle of vibration. In other words, each subsection will perform a translational motion.

In the last-mentioned vibration mode, the vibrator or vibrators of each subsection can be controlled to vibrate with a phase shift relative to the vibrator or vibrators of the adjacent subsection in a manner such that back support section 16 performs an undulating motion progressing longitudinally from one end thereof to the other and imparts a corresponding undulating motion to the spine of the patient so that the spine may be moved to follow the shape of the wave 300 shown in FIG. 11. The amplitude of the cyclical (up and down) movement of each vertebra is reduced as the wave moves up the spine of the patient. This reduction in amplitude is partly explained by the friction between each vertebra. If desired, this undulating motion can be modified by combining it with an angular motion of subsections 17–21 about longitudinal axis L, as described above, and a resulting angular motion of the vertebrae, as described above.

One or more of the vibratable subsections may be provided with more than one vibrator so that composite vibrations may be applied to one and the same subsection. Thus, in the exemplary embodiment of FIGS. 1 to 3, the subsections 17 and 21 may provided with two vibrators 26, 27 and 28, 29 each. By suitably controlling the timing of the cyclical waves produced by these vibrators, the subsections 17 and 20 may be made to swing about one or the other, or both, of longitudinal axis L and a transverse axis T which is generally horizontal, i.e., generally parallel to the back plane S.

The vibration parameters, such as the mode of the vibration, the vibration frequency or frequencies, the vibration amplitude or amplitudes and vibration phase shift from one subsection or part of back support section 16, are selected from case to case in accordance with the needs of the patient. The vibrations contribute to bringing about a relaxation of the muscles of the patient and, in conjunction with the traction applied by the force of gravity, a separation of the vertebrae, not only in the longitudinal direction of the patient's spine but also transversally may be accomplished.

The vibrators may be controlled by means of an electronic control device 69 on which the vibration parameters may be selected.

Although it is believed to be preferably to provide each vibratable subsection 17–21 of the back support section 16 with its own vibrator, it is within the scope of the invention to vibrate two or more subsections by means of a common vibrator assembly. Naturally, it is also possible, if desired, to vibrate all subsections synchronously by operating all vibrators in synchronism.

It is also within the scope of the invention to make the vibratable subsections vibratable in different modes such as permitting the waves to be generated in phase shifts to that one wave is for example, 90 or 180 behind or ahead of another wave. Also, one or more subsections may be constrained for movement with only one degree of freedom, e.g., only along longitudinal axis L. Moreover, all subsections need not necessarily be movable and vibratable.

One or more of the vibratable subsections 17–21 may be provided on their upper side with separate upstanding abutment members, preferably adjustable or readily replaceable, which are adapted to engage a single vertebra or a group of vertebrae during the traction treatment and apply a separate, purposely directed load to that vertebra or group of vertebra. Such abutment members are indicated diagrammatically at 34 in FIG. 2.

One feature of the invention is that the back support section, or one or more portions or subsections thereof, can be vibrated asymmetrically with respect to the stationary portion of the body support platform, i.e., the base section of the body support platform, such that the back support section or each vibratable portion or subsection changes its amplitude to the base section, and thereby its amplitude to one or both of median plane M and back plane S, in accordance with a predetermined selected pattern.

In the embodiment shown in FIGS. 4 and 5, in which reference numerals 11–14, 16, 17 and 22 designate elements which are equivalent to the correspondingly designated elements which are equivalent to the correspondingly designated elements in FIGS. 1–3, the back support section 16 is not subdivided into subsections as in FIGS. 1–3. Instead, the back support section 16 is a single flat section supported by resilient mounting members 22 such that the section 16 can be moved linearly along back plane S, angularly about longitudinal axis L or transverse axis T (the location of which may vary along the of the section) or both axis L and axis T, or up and down relative to back plane S without changing its attitude or angular position relative to planes M and S. The motions of back support section 16 may be produced by four electrically powered vibrators 41–44 positioned near the corners. A control box for electronically controlling the vibrators and selecting the vibration parameters is indicated at 45.

The back support section 16 in FIGS. 4 and 5 should possess some degree of flexibility such that it can be warped or twisted slightly and flex to provide the combined undulating and twisting motion described above with reference to the back support section 16 of the embodiment of FIGS. 1–3. The undulating motion is a result of an interplay of the vibration parameters with the elastic and other parameters of the back support section and it may be necessary to carry out some testing to arrive at the combination of parameters which provides the desired vibration and motion pattern.

In FIG. 4, the body support platform or table 12 is shown in full lines in horizontal position of body support platform 12, which is held in this position by a strut 44 pivotally mounted on base 11.

Figure 6:
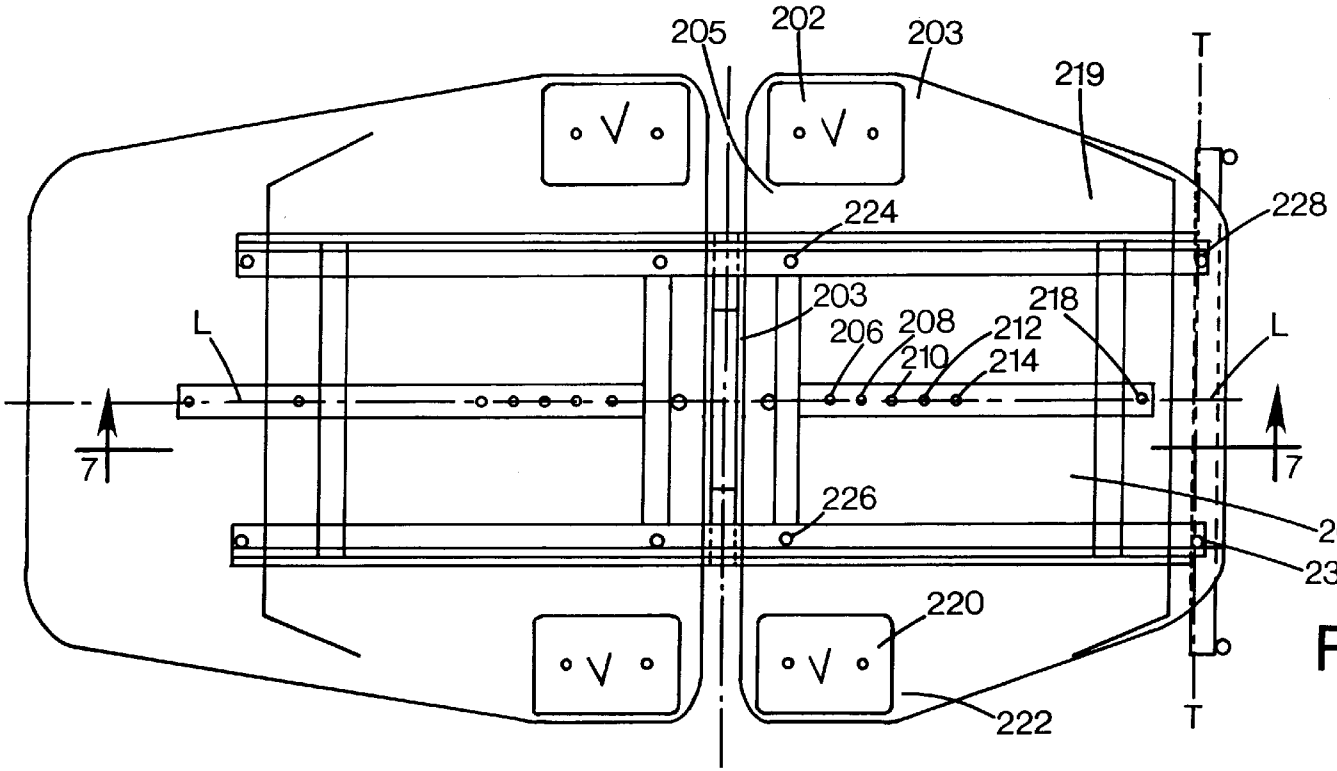
FIG. 6 is a top view of a second embodiment of the present invention.
Figure 7:
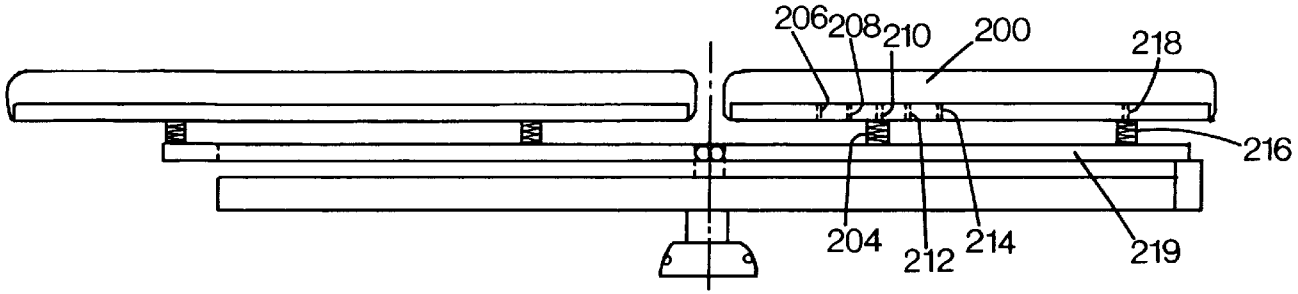
FIG. 7 is a side view along line 7—7 in FIG. 6.

With reference to FIGS. 6–7, a support member 200 has a first vibrator 202 in operative engagement therewith at a left side 203 of the support member 200. The support member 200 is supported by a first resilient member 204 disposed in the middle of the support member 200 along its longitudinal axis L. The member 204 may be positioned in one of the positions 206, 208, 210, 212, and 214 depending upon the weight of the patient lying on the support member 200. If the person is heavy, it is preferred to place the member 204 in position 212 or 214 to maximize the length of the member 204 and a bottom end 203 below the hip or the patient laying on the support member to increase the effect and amplitude of the undulating movement of the bottom end of the support member. If the patient is unusually light weight, the member 204 should be placed in position in positions 206 or 208 to shorten the distance to the bottom end 203. The support member 200 may also be supported by a resilient member 216 at a position 218 disposed close to the head of the patient. The members 204 and 216 are supported by a frame section 219.

A second vibrator 220 may be disposed at a right side 222 of the support member 200. The second vibrator 220 may be similar to the vibrator 202. A set of vibration limitors 224, 226, 228 and 230 may be placed at each corner of the support member 200 and attached to the frame section 219. The limitors 224 and 226 may be softer than the limitors 228 and 230. Preferably, the limitors are made of a suitable rubber or any other material.

Figure 12:
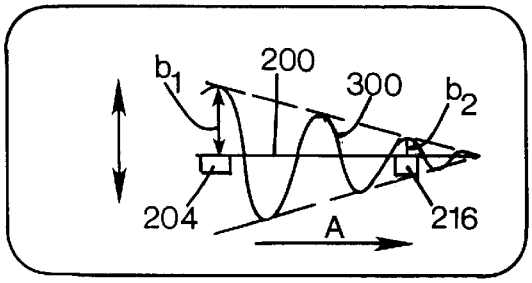
FIG. 12 is a schematic view of a longitudinal or transversal wave with a reducing amplitude.

In operation, the vibrator 202 generates cyclical vibration waves that travels longitudinally along the longitudinal axis L and simultaneously a cyclical rocker or tilting motion about the longitudinal axis. As best shown in FIG. 11, the amplitude of the longitudinal wave of the first wave is the greatest close to the bottom end 203 and the amplitude is gradually reduced as the wave travels along the longitudinal axis of the support member 200. A second wave may also be generated in the longitudinal direction that is shifted about 180 degrees behind the first wave, as shown in FIG. 12. The limitors 224–230 prevent the support member 200 from tilting too much about the longitudinal axis L when the patient gets on and off the support member 200. The limitors 224–230 also maximizes the amplitude of the vibration wave cycles. The limitors may be made of a rubber or any other suitable resilient material. The limitors are generally more firm than the resilient members 204 and 216. If the limitors 220 and 230 are firmer than the limitors 224 and 226, the support member 200 is permitted to vibrate at higher amplitudes at the bottom end 203 where the softer limitors 224 and 226 are located. However, it is not necessary that the limitors 228, 230 are so firm that the support member 200 will act as if it is attached at the top end of the support member 200 that engages the limitors 228, 230. Because the limitors 228, 230 are more firm, the support member 200 is permitted to vibrate longitudinally about a transverse axis T at the limitors 228, 230. Also, because the limitors 228, 230 are more firm, the support member 200 is permitted to twist or repeatedly be tilted about the resilient members 204 and 216 at the longitudinal axis L particularly at the bottom end 203. In this way, the support member 200 may cyclically tilt about the resilient member 204 at, for example, position 210 and resilient member 216 at the position 218. The amplitude $b_1$ at the resilient member 204 is greater than the amplitude $b_2$ of the longitudinal waves at the member 216. In other words, the support member 200 may cyclically tilt about the longitudinal axis at resilient members 204, 216 and longitudinally vibrate about the transverse axis T of the limitors 228, 230. This also means that the spine of the patient is subjected to a longitudinal cyclical motion that has the greatest amplitude at the pelvis of the patient and a cyclical twisting motion. The combination of simultaneous longitudinal waves and cyclical tilting motions urges the spine to follow a helical path and built in tensions in the spine all the directions may be removed. The waves lose some of their energy as the waves move from one vertebra at the pelvis to another vertebra closer to the neck of the patient. Also, the spine is subjected to a twisting or torsional cyclical motion because the bottom end 203 repeatedly tilts back and forth about the members 204, 216. The cyclical twisting motion is less significant at the position 218 because the limitors 228, 230 are relatively stiffer than the limitors 224, 226.

By simultaneously exposing the spine 4 to both the longitudinal waves and the undulating tilt motion, the spine is moved to follow the helical path so that the spine is not only moved up and down by also from side to side.

If necessary, the second vibrator 220 may also be used. The second vibrator 220 may either by synchronized with the vibrator 202 or be phase shifted 180 degrees or lag about half a cycle time period to generate the tilting about the longitudinal axis so that the spine 4 is subjected to more forceful cyclical twisting or torsion forces. Of course, the vibrator 220 may be fully synchronized with the vibrator 202 or adjusted to lag more or less than 100 degrees behind the vibrator 202.

Figure 8:
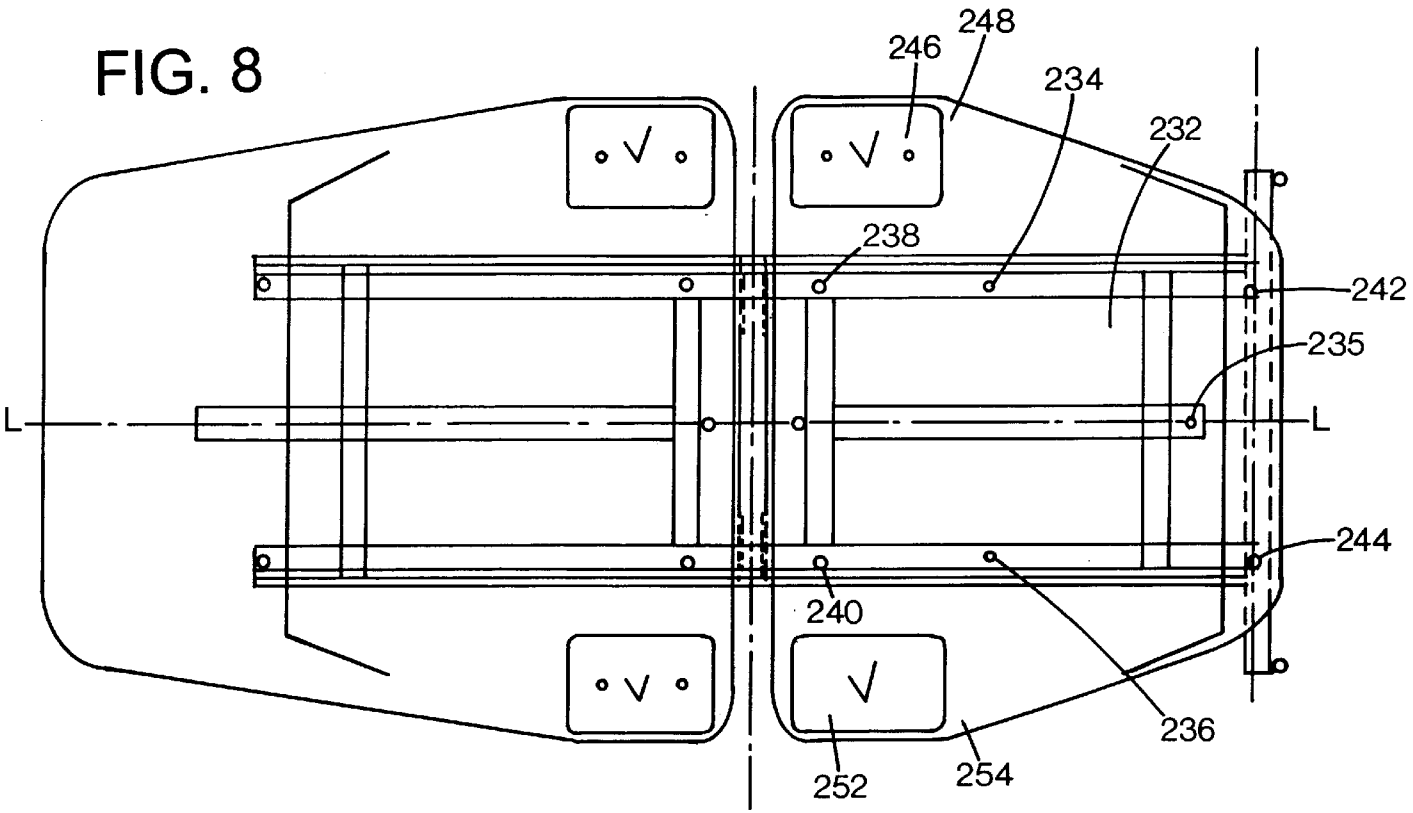
FIG. 8 is a top view of a third embodiment of the present invention.

FIG. 8 is very similar to FIG. 6 except that the support member 232 has a set of resilient members 234 and 236 disposed at the right and left side, respectively, of the support member 232. Similar to the embodiment shown in FIG. 6, a set of vibration limitors 238, 240, 242 and 244 may be placed at each corner of the support member 232. The limitors 238 and 240 are preferably softer than the limitors 242 and 244.

The support member 232 may have a vibrator 246 attached to a right side 248 of the support member 233. In the preferred embodiment, the resilient member 234 is slightly firmer than the resilient member 236 when only one vibrator 246 is used on the right side 248. A resilient member 235 may be disposed in the middle of the longitudinal axis L of the support member 232 adjacent the head or neck of the patient laying on the support member 232. A second vibrator 250, disposed on a left side 252, may also be used.

In operation, the vibrator 246 generates a cyclical tilting motion about the longitudinal axis L and longitudinally waves along the longitudinal axis of the support member 232. As explained below, it is preferred that the resilient member 234 is more firm than the resilient member 236 to expose both side of the pelvis to about the same altitude or tilting motion when only one vibrator 246 that is located on one side of the support member is used.

Because the limitors 242, 244 are more firm than the limitors 238, 240, the support member 232 may vibrate about the transverse axis T at the limitors 242, 244. In this way a patient laying on the support member 232 is subjected to both tilting and longitudinally directed vibrations. The second vibrator 252 may also be used to generate tilting and longitudinal vibration cycles.

The longitudinal waves generated by the vibrator 252 may either be synchronized with the longitudinal waves generated by the generator 246 or there may be a 100 degree time delay or any other phase shift between the two waves so that the wave from the vibrator 252 is, for example half a cycle, behind the wave transmitted by the vibrator 246.

Figure 13:
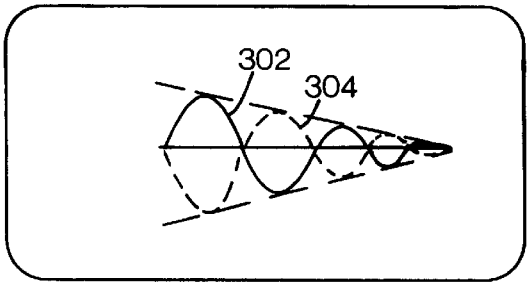
FIG. 13 is a schematic view of two longitudinal or transversal waves.

When only one vibrator, such as vibrator 246, disposed on one side of the back support is used, the position of the spine of the patient is particularly important. As schematically illustrated in FIG. 13, an equilibrium point or center point of the tilting vibration 400 about the longitudinal axis does not coincide with the spine 4 of the patient if the member 234 has the same firmness as member 236. Because the member 234 is closer to the vibrator 246, the side 248 is going to tilt up and down about the longitudinal axis L at a higher amplitude $a_1$ than an amplitude $a_2$ of the side 254 where the member 236 is located so that the equilibrium point 400 is shifted beyond the longitudinal axis of the back support and the spine of the patient viewed from the vibrator 246 (see FIG. 13). This may mean that the right side of the pelvis may tilt up and down at a higher amplitude than the left side of the pelvis if the patient is lying on his/her back in the center of the support member.

Figure 14:
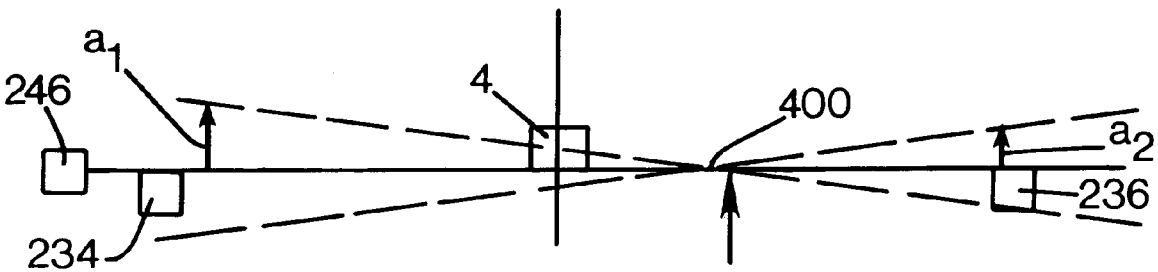
FIG. 14 is a schematic view of a tiltable motion having a tilt center that is remote with the longitudinal axis of the spine.

However, by using a slightly firmer member 234 the amplitude of the tilting motion is reduced and the equilibrium point 400 is shifted towards the center of the back support to coincide with the location of the spine 4 of the patient, assuming that the patient is lying in the middle of the back support, as shown in FIG. 14. In other words, because the member 234 is closer to the vibrator, it is necessary to make the member 234 more firm to prevent the side 248 to cyclically tilt at a higher amplitude compared to the side 254 where the member 236 is disposed. Of course, it is possible to ask the patient to move sideways on the back support until the spine is located at the equilibrium point if the firmness of member 234 is the same as the firmness of member 236 and only one vibrator located on one side is used.

Figure 9:
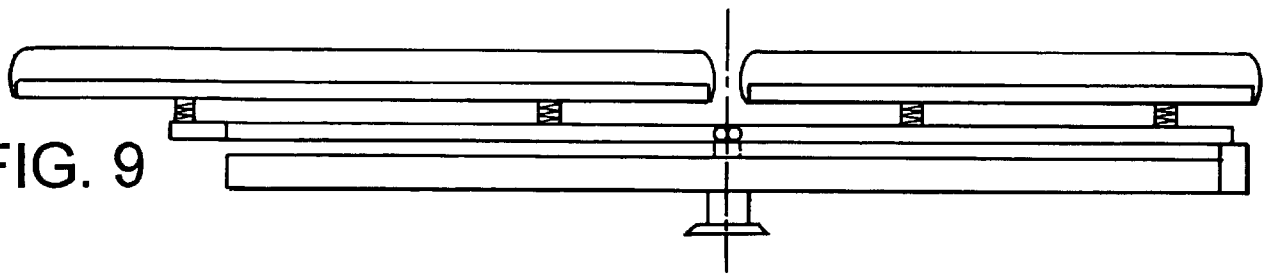
FIG. 9 is a side view along line L—L in FIG. 8.
Figure 10:
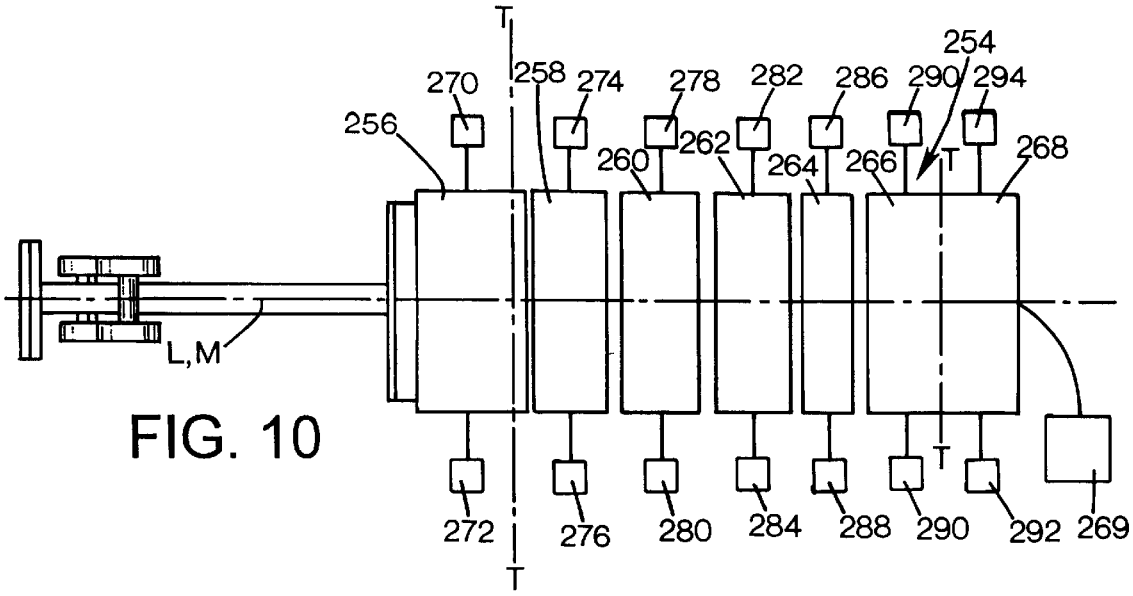
FIG. 10 is a top view of a fourth embodiment of the present invention.

FIGS. 9–10 illustrate yet an alternative embodiment of the present invention. A back support 254 is divided into back sections 256, 258, 260, 262, 264, 266 and 268 similar to the embodiment shown in FIG. 2. The back sections 258–268 have vibrators 270–294 attached to the opposite side of the back sections. The vibrators are connected to a computer so that the timing between the cycles and the amplitude generated by each vibrator may be carefully controlled and monitored. In this way, a maximum altitude M of the total vibration cyclical amplitude curve 310 (best shown in FIG. 10) applied to the spine 4 of the patient may be moved backward and forward along the spine of the patient. In other words, the maximum altitude M may be created by allowing the maximum altitude of several vibration cycles generated by the vibrators to coincide so that they enforce one another. The curve 310 may be characterized as the total sum of all the vibration waves generated by the vibrators 270–294. As discussed above, the pairs of vibrators may either be synchronized or phase shifted a certain amount of degrees, such as 180 degrees, relative to one another. However, the time delay or cycle phase shifting between the vibrators disposed along the longitudinal axis may be carefully controlled and modified by a computer 269 connected to all the vibrators.

In this way, the maximum amplitude of the total amplitude of all the waves generated by the vibrators may be moved up and down the spine of the patient by changing the amplitude and phase shifting of the various longitudinal waves. The frequency of the vibrators may also be varied. It has shown be acceptable to use a frequency of about 10 Hz for about 15–20 minutes. A higher frequency such as, 20 Hz, may also be used by the time period of application should be shortened to only about 1–2 minutes. A too high a frequency may injure the spine. A frequency that is too low may not vibrate the vertebras sufficiently to be effective.

The position or the patient laying on the support member may vary. For example, the head may be below the feet as shown in FIG. 1. The patient may also lie horizontally or with the back in a horizontal position but with the leg in an inclined upward position. The legs may also be horizontal while the back is in an inclined upward position.

Figure 15:
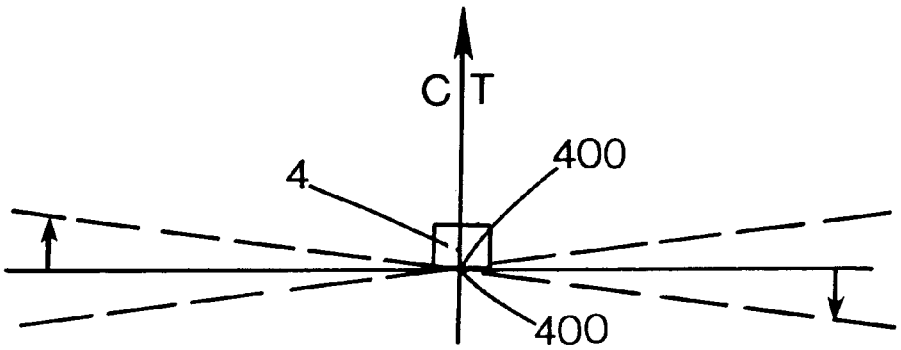
FIG. 15 is a schematic view of a tiltable motion having a tilt center that coincides with the longitudinal axis of the spine.
Figure 16:
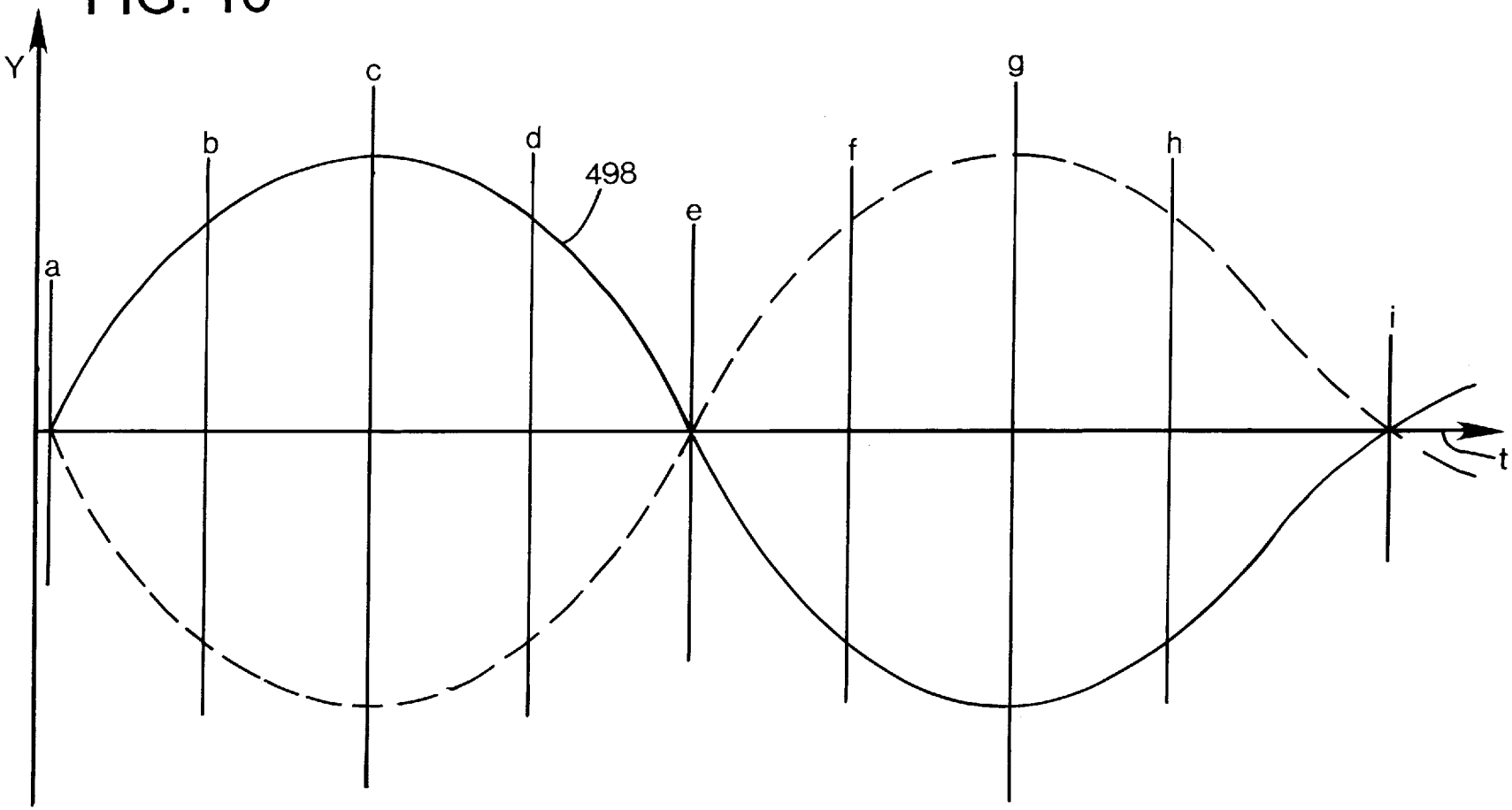
FIG. 16 is a schematic view of the sinusoidal longitudinal wave generated by the vibrator.
Figure 17A:
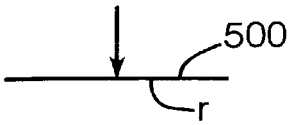
FIGS. 17*a*–17*i* are schematic views of the cyclical vertical movement of the support member compared to a reference plane.
Figure 17B:
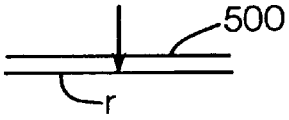
Figure 17C:
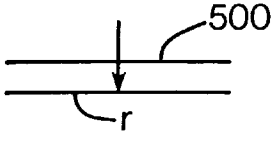
Figure 17D:
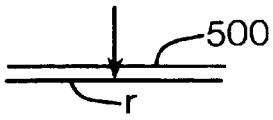
Figure 17E:
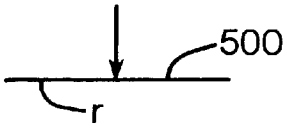
Figure 17F:
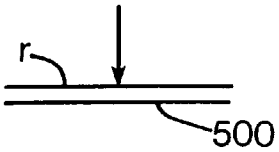
Figure 17G:
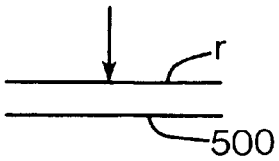
Figure 17H:
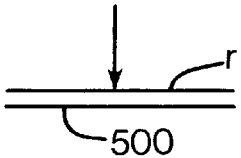
Figure 17I:
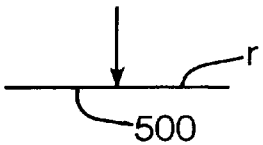
Figure 18A:
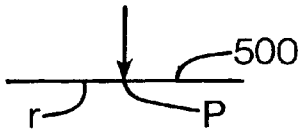
FIGS. 18*a*–18*i* are schematic view of the cyclical tilting motion of the support member compared to a reference plane.
Figure 18B:
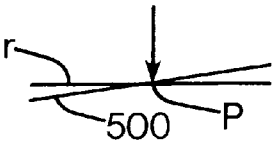
Figure 18C:
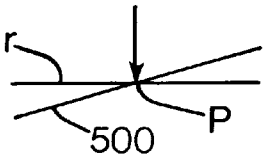
Figure 18D:
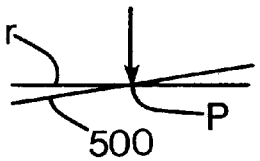
Figure 18E:
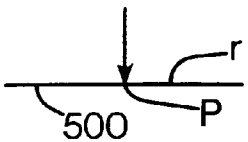
Figure 18F:
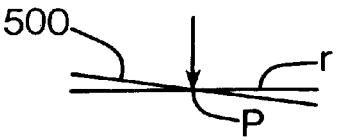
Figure 18G:
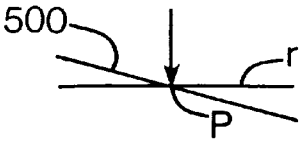
Figure 18H:
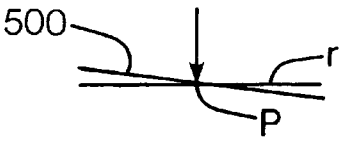
Figure 18I:
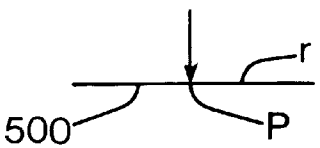

FIGS. 15–17 schematically illustrate the cyclical motion of, for example, the support members 200 and 232 illustrated in FIGS. 6 and 8. FIG. 15 shows a sinusoidal wave 498 extending along a time axis (t). The wave 498 corresponds to the longitudinal wave along the spine of the patient that is generated by the vibrators discussed above. The amplitude of the wave 498 affecting the cyclical motion of the support member (and thus the spine of the patient) is shown in the vertical y-axis. For simplicity, only one wave 498 has been shown. The sinusoidal wave 498 have been divided into sections *a–i*. FIGS. 16*a*–16*i* show the equivalent vertical movement of the support member 500 relative to a reference plane (r). As can be seen, FIG. 16*d*, for example, corresponds to the section (d) in FIG. 15. FIGS. 17*a*–17*i* illustrate the cyclical tilting section about a tilting point (F) of the support member 500 relative to the same reference plane (r) as in FIG. 16. As discussed above, the tilting motion may be generated by the generated by the central vibrator 32 in FIG. 3 or vibrators 202 or 246 in FIGS. 6 and 8 by generating a second longitudinal sinusoidal wave that is phase shifted relative to the first sinusoidal wave. For example, FIG. 17*c* corresponds to the position illustrated in section (c) of FIG. 15 and FIG. 16*c*.

While the present invention has been described in accordance with preferred compositions and embodiments, it is to be understood that certain substitutions and alterations may be made thereto without departing from the spirit and scope of the following claims.

I claim:

1. A method of passive-motion treating a patient having a pelvis and a spine including a first, second and third vertebra extending along a longitudinal axis thereof, the method comprising:

providing an elongate support member movable relative to a base member, the support member having a longitudinal axis and being supported by a first and a second resilient member, the support member having a first end portion and a second opposite end portion, a hard limitor attached to the base member for limiting vibrational movement of the first end portion of the support member and a soft limitor attached to the base member for limiting vibrational movement of the second opposite end portion of the support member, the soft limitor being softer than the hard limitor, the hard limitor and the soft limitor being in operative engagement with the support member;

with a first vibrator attached to a first side portion at the second end portion of the support member, vibrating the second end portion of the support member about a transverse axis at the hard limitor to generate vibrational waves in the support member that travel in a longitudinal direction along the support member;

the first vibrator tilting the support member about the longitudinal axis of the support member in a cyclical motion to create a cyclical tilting motion moving in a transverse direction perpendicular to the longitudinal direction; and simultaneously exposing the spine to the waves moving in the longitudinal direction and the cyclical tilting motion moving in the transverse direction; and the waves and the cyclical tilting motion of the support member moving the spine along a helical path.

2. The method according to claim 1, wherein the method further comprises providing the helical path with a gradually declining amplitude as the spine is moved along the helical path.

3. The method according to claim 1 wherein the method further comprises positioning the first resilient member having a first firmness adjacent to the first vibrator and positioning the second resilient member having a second firmness remote from the first vibrator, the first firmness being greater than the second firmness and adjusting a tilting point of the cyclical tilting motion by increasing the first firmness.

4. The method according to claim 1 wherein the method further comprises applying a second vibrator to the support member, the second vibrator being phase shifted half a cycle time period behind the first vibrator.

5. The method according to claim 1 wherein the method further comprises moving the first resilient member away from the second and along the longitudinal axis of the support member.

6. The method according to claim 1 wherein the method further comprises moving the first resilient member towards the bottom end.

7. The method according to claim 1 wherein the method further comprises providing the helical path with a center of tilting and moving the center of tilting by adjusting the firmness of the first resilient member.

* * * * *